United States Patent [19]

Nagatsuka et al.

[11] Patent Number: 4,868,083

[45] Date of Patent: Sep. 19, 1989

[54] DEVELOPER CARRIER AND PROCESS FOR PRODUCING THE SAME

[75] Inventors: Ikutaroh Nagatsuka; Yasuo Matsumura; Masayuki Takeda; Chiaki Suzuki; Takayoshi Aoki, all of Kanagawa, Japan

[73] Assignee: Fuji Xerox Co., Ltd., Tokyo, Japan

[21] Appl. No.: 77,727

[22] Filed: Jul. 27, 1987

[30] Foreign Application Priority Data

Jul. 25, 1986 [JP] Japan ..... 61-173559
Jul. 25, 1986 [JP] Japan ..... 61-173560

[51] Int. Cl.[4] ..... G03G 9/10

[52] U.S. Cl. ..... 430/108; 430/111; 430/137; 427/218; 427/221; 264/13

[58] Field of Search ..... 430/137, 108, 111; 427/218, 221; 264/13

[56] References Cited

U.S. PATENT DOCUMENTS 3,873,355 3/1975 Queener et al. ..... 430/108
3,961,106 6/1976 Heytmeijer ..... 264/13
4,218,530 8/1980 Lu ..... 430/110 X
4,248,954 2/1981 Datta ..... 430/110 X
4,434,220 2/1984 Abbott et al. ..... 430/111 X

*Primary Examiner*—J. David Welsh
*Attorney, Agent, or Firm*—Sughrue, Mion, Zinn, Macpeak & Seas

[57] ABSTRACT

A process for producing a developer carrier is disclosed, which comprises heating a carrier composition containing a resin, magnetic particles and a compound having a lower critical surface energy than the resin, to produce a carrier particle having a higher surface concentration of the compound having a lower critical surface energy. A developer carrier having an average particle size of at least about 50 μm and containing a fluorine-containing compound and fine magnetic particles dispersed in a binder resin is also disclosed. The developer carriers according to the invention when used in magnetic brush development provide superior charge generation, extended life and improved image reproduction.

38 Claims, No Drawings

DEVELOPER CARRIER AND PROCESS FOR PRODUCING THE SAME

FIELD OF THE INVENTION

The present invention relates to a process for producing a carrier which is one of the two components of a developer used in development of a latent electrostatic or magnetic image in electrophotography, electrostatic recording or electrostatic printing. Another aspect of the present invention relates to a carrier of the type which has a magnetic material dispersed therein.

BACKGROUND OF THE INVENTION

Electrophotographic processing is commonly performed by a precedure in which a latent electrostatic image is formed by various electrical means on a photoreceptor made of selenium or some other suitable photoconductive materials and toner particles are deposited on the latent image by a suitable method of development, such as a magnetic brush method, to produce a visible image.

In the development step, carrier particles are used in order to impart an appropriate amount of positive or negative electrical charge to the toner. Various types of carriers have been developed and used commercially.

While carriers are required to possess various characteristics, particularly important requirements include appropriateness of the polarity of charges generated by electrification, high impact and wear resistance, efficiency in development, and long developer life. In these respects, conventional carriers are still inadequate, and a product having satisfactory characteristics has not yet been achieved. For example, iron oxide powders and other electrially conductive carriers are capable of producing solid developed images of high quality but are not equally effective in reproducing fine lines of good quality. Furthermore, they require a special charge control agent to be incorporated in the toner in order to extend the life of the developer. Developers using coated carriers (i.e., with an insulating coating) have an extended life and the capability of reproducing fine lines of good quality, but they are ineffective in reproduction of solid developed images of high quality. With a view to solving these problems, microtoning carriers, i.e., carriers consisting of small-diameter particles in which fine magnetic particles are dispersed in a binder resin have been proposed and commercialized. However, they have not completely solved the problem of short developer life, because small-diameter carrier particles have a great tendency to adhere to the surface of the photoreceptor; their chargeability varies under hot and dry conditions on account of magnetic particles that have separated from the carrier surface; and they are not highly responsive to surface treatments. While adhesion can be prevented by employing larger particles in the carrier, as a result its chargeability is reduced, causing problems such as fogging and fouling of the interior of a copying or recording machine.

SUMMARY OF THE INVENTION

An object, therefore, of the present invention is to provide a process for producing a novel carrier for use in magnetic brush development of a latent electrostatic image in electrophotography or electrostatic recording.

Another object of the present invention is to provide a process for producing a carrier for use in magnetic brush development that is free from the problem of loss of charge in the course of running operation, because of its high resistance to surface soiling.

A further object of the present invention is to provide a novel carrier for use in the magnetic brush development of a latent electrostatic image in electrophotography or electrostatic recording.

Yet another object of the present invention is to provide a large-particle carrier for use in magnetic brush development that will not adhere to the photoreceptor, and that retains the charges generated to prevent not only premature fogging but also to avoid the fouling of the interior of a copying or recording machine.

An additional object of the invention is a carrier that extends the life of the developer and permits rapid development.

It has now been found that these and other objects of the present invention can be attained by a process for producing a carrier particle having a higher surface concentration of a compound having a lower critical surface energy than a binder resin of the carrier particle.

In another aspect, the present invention relates to a carrier having an average particle size of at least about 50 μm, and containing a fluorine-containing compound and fine magnetic particles dispersed in a binder resin.

DETAILED DESCRIPTION OF THE INVENTION

As is generally known, two compounds having considerably different critical surface energies are not miscible with each other and the compound having the lower critical surface energy is concentrated on the surface of a mixture of the two, outside of the compound having the higher critical surface energy. Accordingly, a carrier particle having a higher concentration of a compound of low critical surface energy at its surface than in its interior can readily be attained though no separate layers are present in the carrier particle. The present inventors have also found that in the resulting carrier particle, different functions effectively fulfilled by different particle regions, and more specifically, that the surface portion is responsible for controlling chargeability and fluidity while the bulk portion serves to retain toner particles in position.

According to the present invention, a desired carrier particle having the two particle regions can be produced by the step of heat-treating a carrier composition that contains a binder resin, magnetic particles, and a compound having a lower critical surface energy than the binder resin.

Examples of the compound having a lower critical surface energy which can be used in the present invention include those having a low critical surface tension of not more than about 25 dyn/cm and preferably not more than 20 dyn/cm, such as fluorine-containing compounds and silicone-containing compounds.

The term "critical surface tension" is described in detail in *Fukugo Zairyo Koqaku (Composite Material Engineering)*, published by Nikkagiren Shuppan, pp. 148–153 (September, 1971), and it is determined by the following manner: contact angles ($\theta$) of various kinds of liquid having different surface tensions ($\gamma L$) are measured on a test material using a contact angle measuring apparatus (CA-D type, produced by Kowa Kaimen Kagaku Co.); the surface tension ($\gamma L$) and the contact angle ($\theta$) or the value of cos $\theta$ of each liquid are plotted to obtain a straight line, a so-called Zisman plot; and then the surface tension at $\theta 0$ or $\cos\theta = 1$ is obtained by extra-polation of the Zisman plot, which is defined as critical surface tension (γc).

Suitable fluorine-containing compounds include polymers having fluorine in the backbone chain, such as homopolymers of such monomers as tetrafluoroethylene, trifluoroethylene, vinylidene fluoride, monofluoroethylene and hexafluoropropylene, and copolymers of these monomers with other copolymerizable unsaturated monomers such as ethylene, propylene, butylene, vinyl chloride, vinylidene chloride and trifluoroethylene.

Also advantageous are polymers of monomers having fluorine in side chains, for example, such as fluorinated alkyl acrylates and fluorinated alkyl methacrylates. Specific examples include esters of acrylic acid or methacrylic acid with alcohols, such as 1,1-dihydroperfluoroethyl, 1,1-dihydroperfluoropropyl, 1,1-dihydoperluorohexyl, 1,1-dihydroperfluorooctyl, 1,1-dihydroperfluorodecyl, 1,1-dihydroperfluorolauryl, 1,1,2,2tetrahydroperfluorobutyl, 1,1,2,2-tetrahydroperfluoro-hexyl, 1,1,2,2-tetrahydroperfluorooctyl, 1,1,2,2-tetrahydroperfluorodecyl, 1,1,2,2-tetrahydroperfluorolauryl, 1,1,2,2-tetrahydroperfluorostearyl, 2,2,3,3-tetrafluoropropyl, 2,2,3,3,4,4-hexafluorobutyl, 1,1,ω-trihydroperfluorohexyl, 1,1,ω-trihydroperfluorooctyl, 1,1,1,3,3,3-hexafluoro-2-chloro-propyl, 3-perfluorononyl-2-acetylpropyl, 3-perfluorlauryl-2-acetylpropyl, N-perfluorohexyl-sulfonyl-N-methylaminoethyl, N-perfluorohexylsulfonyl-Nbutylaminoethyl, N-perfluorooctylsulfonyl-N-methylaminoethyl, N-perfluorooctylsulfonyl-N-ethylaminoethyl, N-perfluorooctylsulfonyl-N-butylaminoethyl, N-perfluorodecylsulfonyl-N-methylaminoethyl, N-perfluorodecylsulfonyl-Nethylaminoethyl, N-perfluorodecylsulfonyl-N-butylaminoethyl, N-perfluorolaurylsulfonyl-N-methylaminoethyl, N-perfluorolaurylsulfonyl-N-ethylaminoethyl, and N-perfluorolaurylsulfonyl-N-butylaminoethyl.

These fluorinated alkyl acrylates or methacrylates may be copolymerized with the following components:

(a) styrene monomers such as styrene, alkylstyrenes, (e.g., methylstyrene, dimethylstyrene, trimethylstyrene, ethylstyrene, diethylstyrene, triethylstyrene, propylstyrene, butylstyrene, hexylstyrene, heptylstyrene, and octylstyrene), halogenated styrenes (e.g., fluorostyrene, chlorostyrene, bromostyrene, dibromostyrene, and iodostyrene), as well as nitrostyrene, acetylstyrene, and methoxystyrene;

(b) addition polymerizable unsaturated carboxylic acids including unsaturated aliphatic monocarboxylic acids such as acrylic acid, methacrylic acid, α-ethylacrylic acid, crotonic acid, α-methylcrotonic acid, α-ethylcrotonic acid, isocrotonic acid, tiglic acid, and ungelicaic acid; and unsaturated aliphatic dicarboxylic acids such as maleic acid, fumaric acid, itaconic acid, citraconic acid, mesaconic acid, glutaconic acid, and dihydromuconic acid;

(c) esters of these addition polymerizable unsaturated carboxylic acids with alcohols such as alkyl alcohols (e.g., methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol, hexadecyl alcohol), alkoxyalkyl alchols in which alkyl alcohols are partially alkoxylated (e.g., methoxyethyl alcohol, ethoxyethyl alcohol, ethoxyethoxyethyl alcohol, methoxypropyl alcohol, and ethoxy propyl alcohol), aralkyl alcohols (e.g., benzyl alcohol, phenylethyl alcohol, and phenylpropyl alcohol), and alkenyl alcohols (e.g., allyl alcohol and crotonyl alcohol), the alkyl esters of acrylic acid, methacrylic acid, fumaric acid and maleic acid being particularly preferred;

(d) amides and nitriles derived from the aforementioned addition polymerizable unsaturated carboxylic acids;

(e) aliphatic monoolefins such as ethylene, propylene, butene, and isobutylene;

(f) halogenated aliphatic olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride, and vinylidene fluorode;

(g) conjugated diene-based aliphatic diolefins such as 1,3-butadiene, 1,3-pentadiene, 2,3-dimethyl-1,3-butadiene, 2,4-hexadiene, and 3-methyl-2,4-hexadiene; and (h) nitrogen-containing vinyl monomers such as 2-vinylpyridine, 4-vinylpyridne, 2-vinyl-6-methylpyridine, 2-vinyl-5-methylpyridine, 4-butenylpyridine, 4-pentylpyridine, N-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-peperidone, and N-vinylcarbazole. These comoners may be used either alone or in combination.

Fluorinated epoxy resins, fluorinated polyester resins, and fluorinated silicone resins can also be used as well as fluorine-containing nonpolymeric compounds, including fluorine-based coupling agents such as fluorine-containing alkoxysilanes, fluorine-containing titanium acylates, fluorine-containing alkoxy titanium, and fluorine-containing alkoxy zirconium; fluorine-based surfactants; and other fluorine-containing nonpolymeric compounds.

Typical examples of the silicone-containing compound that can be used as the compound having a lower critical surface energy are polymethylphenyl siloxane and polydimethyl siloxane. Also useful is a "modified" silicone varnish that has been modified with alkyd resins, phenolic resins, or epoxy resins.

The amount of the compound having a lower critical surface energy incorporated in the carrie particle of the present invention generally ranges from about 0.01 to 50 wt%, preferably from about 0.1 to 20 wt%, based on the total amount of binder (i.e., the compound plus the binder resin) for the magnetic particles dispersed in the carrier particle.

The binder resin used in the carrier particle of the present invention may be selected without limitation from any thermoplastic resins in common use. Specific examples are homo- and copolymers of monomers that include styrenes such as styrene, chlorostyrene and vinylstyrene; monoolefins such as ethylene, propylene, butylene and isobutylene; vinyl esters such as vinyl acetate, vinyl propionate, vinyl benzoate and vinyl butylrate; esters of α-methylenealiphatic monocarboxylic acids such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl keton, vinyl hexyl ketone and vinyl isopropenyl ketone. Typical binder resins that can be used in the present invention include polystyrene, styrene/alkyl acrylate copolymers, styrene/alkyl methacrylate copolymers, styrene/acrylonitrile copolymers, styrene/butadiene copolymers, styrene/maleic anhydride copolymers, polyethylene, and polypropylene.

Other suitable binder resins include polyesters, polyurethanes, epoxy resins, silicone resins, polyamides, modified rosin, paraffins and waxes.

In particular, styrene-based polymers, acrylic polymers, or copolymers of styrenes and acrylic monomers are preferably used as the binder resin in combination with the compound of lower critical surface energy, and they are generally used in an amount of about 50 wt. % or more, preferably 70 wt. % or more, based on the total weight of binder for the magnetic parpticles. In the case these resins do not react during production of the carrier particles, even under the heat conditions for melt-mixing with the compound of lower critical surface energy, so that pre-adjusted thermal properties of the resins can be maintained.

Any of the fine magnetic particles that are conventionally used as fine particulate ferromagnetic materials can be dispersed in the binder resin of the carrier particle of the present invention, including such illustrative examples as fine particles of magnetite, gamma-hematite, ferrites, chrominum oxide and other metals. The magnetic particles are generally used in an amount of from about 30 to 95 wt. %, preferably from about 45 to 90 wt. %, of the total amount of the carrier particle.

In addition to the aforementioned binder resin, fine magnetic particles and compound of lower critical surface energy, the carrier of the present invention may contain other additives, such as fine powders of a resin, an antistat, a coupling agent and a filler, for attaining various purposes such as charge control, improving dispersion stability, reinforcement of strength, and providing improved fluidity.

Coating the surface of carrier particles with a low-surface energy compound or forming a surface layer in which the compound is contained in a high concentration could be accomplished by a conventional method such as air suspension coating, spray drying, or vacuum drawing with simultaneous stirring. However, in order to encapsulate the carrier particles by these methods to entirely coat their surfaces with a uniform layer of the low-surface energy compound, the thickness of the coating layer must be fairly large while the low-surface energy compound is generally expensive. Therefore, if one of these methods is employed to form a surface coating of the low-surface energy compound, various properties of the carrier will be impaired: typically as manifested by the adhesion of carrier particles to the photoreceptor, or reduced ability to achieve faithful density reproduction, both phenomena being due to the increased resistance of the thick coating layer.

In contrast, according to the method of the present invention, a very thin surface portion containing a compound of lower critical surface energy in a higher concentration than in the bulk portion can be formed in the carrier particle merely by heat-treating the carrier composition using a less amount of the compound than in the conventional method. Thus, the method of the present invention makes it possible to change the surface properties of the carrier particle without deterioration in various properties of the binder resin used therein.

The process of the present invention is carried out in a heated atmosphere, whereby a compound having a lower critical surface energy than a binder resin comes out in a high concentration in the surface portion of carrier particle. By this technique, the resistance of the carrier particle to soiling, and other functions such as charge control, can be readily improved. In addition, the carrier particle thus prepared has a smooth surface and the surface coating formed thereon is uniform and thin. In these respects, the carrier particle produced by the present invention is far better than conventional coated-type carriers, in which different functions are fulfilled by the surface layer and the bulk portion.

The method of the present invention can be carried out in either of the following two ways. Carrier particles having incorporated therein a compound having a lower critical surface energy than a binder resin are prepared by a conventional method and then subjected to a heat treatment, which may be accomplished by the following procedures: (i) the carrier particles are placed in an appropriate heater, such as an oven, and heated for about 5 to 20 days at a temperature not exceeding the glass transition point (Tg) of the resin (generally at least 20° C. below the Tg) and preferably at a temperature of from 50° to 100° C. and more preferably from 50° to 80° C.; (ii) the carrier particles are heated for about 10 to 40 minutes, preferably about 20 to 30 minutes, while suspended in a heated air stream having a temperature not exceeding the Tg of the resin as in (i) above using a fluidized bed or the like; or (iii) the carrier particles are heated in a thermal spherodizing apparatus for about 0.001 to 0.1 second at a temperature of from about 200° to 400° C., preferably from about 250° to 350° C., wherein the carrier particles are injected into a heated air atmosphere such that the surface temperature of the particles becomes from about 10° to 30° C. higher than the Tg of the binder resin and recovered just before agglomeration of the particles takes place. Alternatively, carrier particles are formed and heated simultaneously so that the compound having the lower critical surface energy will migrate to the carrier surface. More specifically, in this embodiment of the present invention, a mixture containing binder resin, a compound having a lower critical surface energy than the binder resin, and magnetic particles (which optionally can contain any other suitable components) is thermally melted to form an intimate mixture, which is subsequently cooled to solidify in an air stream at a comparatively low temperature.

The carrier particles to be produced in accordance with the present invention generally have an average particle size of from about 10 to about 400 μm and preferably from about 30 to about 200 μm.

The so prepared carrier may be immediately used as carrier particles. If desired, they may be surface-treated or coated with an appropriate material such as a resin, a coupling agent, a surfactant, a charge control agent or a fine powder. In either case, the carrier is mixed with a toner and used as a developer for rendering a latent electrostatic image visible by the magnetic brush method. The toner may be of any type of chargeable toners that are conventionally employed in electrophotography and which have a colorant dispersed in a binder resin.

The carrier particles prepared by the process of the present invention which can effectively be used in the development of a latent electrostatic image by the magnetic brush method, have various advantages. It contains spherical particles having a surface portion with low critical surface energy, so it has high resistance to soiling and can be used for a prolonged period without deteriorating. The tendency of the fine magnetic particles to separate from the carrier surface is so small that the carrier is far stabler with respect to environmental factors; particular, it exhibits much smaller fluctuation in the quantity of charge generated in summer and winter than conventional magnetic particle-dispersed carriers which are produced by mixing and grinding techniques.

In another aspect, the present invention relates to a carrier having an average particle size of about 50 μm or more that contains the above fluorine-containing compound as an additive for providing improved chargeability, and fine magnetic particles dispersed in a binder resin. In particular, polytetrafluoroethylene, polyvinylidene fluoride, perfluorohexylethyl methacrylate, 1,1,2,2-tetrahydroperfluorohexyl methacrylate, N-perfluorohexyl-sulfonyl-N-butylaminoethyl methacrylate, and perfluorooctylethyl methacrylate are preferably used as a fluorine-containing compound in this embodiment. Magnetic particles, binder resins, and other additives used herein and the amounts of the components of the carrier particle are the same as described above.

The carrier of this embodiment may be produced by a variety of methods. For example, a binder resin, a fluorine-containing compound and fine magnetic particles can be mixed in a thermally melting/mixing device such as a kneader or a Banbury mixer, after which the resulting mix is ground into particles and particles of a predetermined size are separated for use. Alternatively, the mix can be sprayed in a liquid state, cooled and solidified.

In order to suitably balance the requirement that carrier particles not adhere to the surface of the photoreceptor and the image quality attainable, the carrier of this embodiment can have an average particle size of from about 50 to 400 μm, preferably from about 50 to 100 μm.

The carrier of this embodiment for use in magnetic brush development is comprised of particles in which fine magnetic particles are dispersed in a binder resin which also contains a fluorine-containing compound. In addition, the particles of the carrier are not smaller than about 50 μm. Having these features, the carrier of this embodiment attains the following advantages.

First, this carrier is substantially free of unwanted micro particles because they have been removed in the manufacturing process. As a result, the chance of the carrier particles adhering to the photoreceptor is greatly reduced, compared with the conventional small-particle carrier in which fine magnetic particles are dispersed.

Secondly, the chargeability of the carrier can be controlled by adjusting the type and amount of the fluorine-containing compound, permitting its chargeability to be appropriately adjusted in spite of the large size of the particles which it contains. The fluorine-containing compound has the additional advantage of lowering the surface energy of the carrier, so that its contamination by toner particles can be effectively prevented to extend the life of the developer and ensure consistent charging.

The following examples and comparative examples are provided for the purpose of further illustrating specific embodiments of the present invention, but are not to be construed as limiting its scope. In the example and comparative examples, all parts, percents and ratios are by weight unless otherwise indicated.

EXAMPLE 1

Seventy-five parts of fine magnetic iron oxide particles (average diameter: 0.3 μm; EPT-1000 manufactured by Toda Kogyo Co.), 21 parts of a polyester (polycondensation product of hydrogenated bisphenol A and fumaric acid; glass transition point: 80° C.), and 4 parts of a copolymer of perfluorohexylsulfonyl-N-ethyl methacrylate and butyl methacrylate (weight ratio: 30/70; critical surface tension (γc): 18 dyn/cm; weight average molecular weight ($\overline{Mw}$): 5,000) were thermally melted and mixed at 150° C. (at maximum) for 15 minutes in a pressure kneader. The resulting mix was ground into particles which were classified and left heated in an oven at 60° C for 10 days to produce a carrier having an average particle size of 80 μm.

EXAMPLE 2

A carrier was prepared as in Example 1 except that instead of being heated in an oven, the particles were heated with hot air (80° C.) for 1 hour in a fluidized bed.

EXAMPLE 3

A carrier having an average particle size of 85 μm was prepared as in Example 1, except that the molten mixture from the pressure kneader was heated to 200° C. and subsequently cooled with air stream (25° C.) from a spray drier.

COMPARATIVE EXAMPLE 1

A control carrier was prepared as in Example 1 except that the copolymer of perfluorohexylsulfonyl-N-ethyl methacrylate and butyl methacrylate was omitted, and the step of heating in an oven was not performed.

The carriers prepared in Examples 1 to 3 and in the Comparative Example 1 were incorporated in developers and their performance was evaluated as follows. The toner particles used in the developers were the product of Fuji Xerox Co., Ltd., designed for use with a copying machine Model FX-7770. It was composed of a styrene-acrylic resin and carbon black and had an average particle size of 11 μm. The toner content of each developer was 3 wt. %.

The four developer samples were subjected to a copying test using an evaluation bench machine with the speeds of the photoreceptor and the developing magnetic roller (sleeve) set at 350 mm/sec and 550 mm/sec, respectively, so as to evaluate their initial performance (viz., the quantity of charges generated, the density of solid images, and the fog density in the background) and the performance after $10^5$ runs (viz., the quantity of charges generated, the density of solid images, the fog density in the background, and the amount of toner particles adhered to the carrier). The same copying test was conducted both under humid conditions (30° C. and 80%RH) and under dry conditions (10° C. and 30%RH).

The quantity of charges of toner particles (μc/g) was measured by means of a Faraday Cage (a blow off method). The device comprises a stainless steel cylinder having a diameter of about 1 inch and a length of about 1 inch. A screen is positioned at each end of the cylinder, and the screen openings are of such a size as to permit the toner particles to pass through the openings but prevent the carrier particles from making such passage. The Faraday Cage is weighed, charged with about 0.5 g of the carrier particles and toner particles, reweighed, and connected to the input of a coulomb meter. Dry compressed air is then blown through the cylinder to drive all the toner particles from the carrier particles. As the electrostatically charged toner particles leave the Faraday Cage, the oppositely charged carrier particles cause an equal amount of electronic charge to flow from the Cage, through the coulomb meter, to ground. The coulomb meter measured this charge which is then taken to be the charge on the toner particles which was removed. Next, the cylinder is reweighed to determined the weight of the toner particles removed. The resulting data are used to calculate the average charge to mass ratio of the toner particles.

The density of solid images and the fog density at the background were measured using a densitometer, Macbeth RD-517 produced by Macbeth Co., with reference to a gray scale produced by Eastman Kodak Co.

The adhesion of toner particles to carrier surface was measured in terms of the amount (g) of toner particles adhered to 1 g of the carrier and not removed by washing with an aqueous solution of surface active agent after $10^5$ runs.

The test results are shown in the following Table 1, from which the superiority of the carrier prepared in accordance with the present invention is seen.

late copolymer (weight ratio: 85/15) were mixed, ground and classified as in Example 4 to prepare carrier particles with an average particle size of 100 μm which had the fine magnetic particles dispersed therein.

EXAMPLE 5

Sixty parts of fine magnetic iron oxide particles (EPT-1000), 25 parts of polyethylene (Mitsui Hiwax 400P manufactured by Mitsui Petrochemical Industries, Ltd.) and 15 parts of trifluoroethylene/vinyl chloride copolymer (γc 20 dyn/cm; FPC 461 manufactured by Firestone Tire & Rubber Company) were melted and intimately mixed at 130° C. (at maximum) for 15 minutes by heating in a pressure kneader. The molten mix was sprayed and cooled to solidify with air stream (25° C) from a disk sprayer and thereafter classified to obtain spherical carrier particles with an average particle size of 100 μm which had the fine magnetic particles dispersed therein.

COMPARATIVE EXAMPLE 3

Sixty parts of fine magnetic iron oxide particles (EPT-1000) and 40 parts of polyethylene (Mitsui Hiwax 400P) as in Example 5 were mixed, cooled to solidify and classified as in Example 5 to obtain spherical carrier particles with an average particle size of 100 μm which had the fine magnetic particles dispersed therein.

TABLE 1

| | Initial performance | | | Environmental test | | After $10^5$ runs | | | | | |
|---|---|---|---|---|---|---|---|---|---|---|---|
| Sample No. | Quantity of charges generated (μc/g) | Density of solid image | Fog density in background | Under summer conditions (30° C., 80% RH) | Under winter conditions (10° C., (30% RH) | Quantity of charges generated (μc/g) | Density of solid image | Fog density in background | Adhesion of toner to carrier surface (mg/g of carrier) | Life (runs) | Overall rating |
| Example 1 | 14 | 1.53 | 0.00 | good | good | 10 | 1.51 | 0.03 | 25 | $>10^6$ | good |
| Example 2 | 12 | 1.48 | 0.00 | good | good | 11 | 1.39 | 0.03 | 29 | >10hu 6 | good |
| Example 3 | 18 | 1.39 | 0.00 | good | good | 16 | 1.42 | 0.01 | 15 | $>10^6$ | good |
| Comp. Example 1 | 10 | 1.51 | 0.00 | increased fog in background due to reduced quantity of charges | good | 5 | 1.10 | 0.11 | 48 | $6 \times 10^5$ | poor |

EXAMPLE 4

Seventy parts of fine magnetic iron oxide particles (EPT-1000), 24 parts of a styrene/n-butyl methacrylate copolymer (weight ratio: 85/15; $\overline{Mw}$: 95,000) and 6 parts of a tetrafluoroethylene resin (γc: 18 dyn/cm; Ruvlon L-2 manufactured by Daikin Kogyo Co., Ltd.) were melted and mixed at 180° C. (at maximum) for 15 minutes in a pressure kneader. The mix was ground in a turbo mill and classified to obtain carrier particles having irregular shapes and an average particle size of 100 μm which had the magnetic particles dispersed therein.

COMPARATIVE EXAMPLE 2

Seventy parts of fine magnetic iron oxide particles (EPT-1000) and 30 parts of a styrene/n-butyl methacry- The carriers prepared in Examples 4 and 5 and in Comparative Examples 2 and 3 were formulated as developers and their performance was evaluated in the same manner as Example 1.

Further, the reproduction of fine line at the initial stage and after $10^5$ runs was examined and evaluated as follows: A (capable of reproducing fine lines of 175 lines/inch), B(capable of reproducing fine lines of 133 lines/inch but not of 175 lines/inch), and C (incapable of reproducing fine lines of 133 lines/inch).

The test results are shown in the following Table 2, from which the superiority of the carrier prepared in accordance with the present invention is seen.

TABLE 2

| Sample No. | Initial performance: Quantity of charges generated (μc/g) | Initial performance: Density of solid image | Initial performance: Fog density in background | Initial performance: Reproduction of fine lines | Environmental test: Under summer conditions (30° C., 80% RH) | Environmental test: Under winter conditions (10° C., 30% RH) | After $10^5$ runs: Quantity of charges generated (μc/g) | After $10^5$ runs: Density of solid image | After $10^5$ runs: Fog density in background | After $10^5$ runs: Reproduction of fine lines | Life (runs) | Overall rating |
|---|---|---|---|---|---|---|---|---|---|---|---|---|
| Example 4 | 15 | 1.38 | 0.00 | A | good | good | 13 | 1.48 | 0.02 | A | $>10^5$ | good |
| Comp. Example 2 | 11 | 1.52 | 0.01 | A | increased fog in background due to reduced quantity of charges | reduced density of solid image due to increased quantity of charges | 7 | 1.40 | 0.08 | C | ca. $4 \times 10$ | poor |
| Example 5 | 15 | 1.40 | 0.00 | A | good | good | 14 | 1.42 | 0.02 | A | $>10^5$ | good |
| Comp. Example 3 | 12 | 1.50 | 0.00 | A | increased fog in background due to reduced quantity of charges | good | 9 | 1.33 | 0.06 | B | ca. $8 \times 10^4$ | poor |

While the invention has been described in detail and with reference to specific embodiments thereof, it will be apparent to one skilled in the art that various changes and modifications can be made therein without departing from the spirit and scope thereof.

What is claimed is:

1. A process for producing a developer carrier capable of inducing an electrostatic charge in a toner mixed therewith, which comprises the step of:

heating a mixture containing magnetic particles, a binder resin for dispersing the magnetic particles and a compound having a lower critical surface energy than the binder resin to obtain a molten mixture, spraying the molten mixture, followed by cooling to obtain carrier particles having an average particle size of about 10 to 40 μm and having the magnetic particles dispersed in the binder resin, and heating the carrier particles, said developer carrier having a higher concentration of the compound having a lower critical surface energy at the surface thereof.

2. The process as claimed in claim 1, wherein said compound having a lower critical surface energy is a fluorine-containing compound selected from the group consisting of (a) homopolymers and copolymers comprising at least one monomer selected from tetrafluoroethylene, trifluoroethylene, vinylidene fluoride, monofluoroethylene, hexafluoropropylene, a fluorinated alkyl acrylate and a fluorinated alkyl methacrylate; (b) a fluorinated epoxy resin; (c) a fluorinated polyester resin; (d) a fluorinated silicone resin; (e) a fluorine-containing alkoxysilane; (f) a fluorine-containing titanium acylate; (g) fluorine-containing alkoxy titanium; (h) fluorine-containing alkoxy zirconium; and (i) a fluorine-containing surfactant.

3. The process as claimed in claim 2, wherein said compound having a lower critical surface energy is a fluorinated alkyl acrylate or methacrylate copolymerized with an alkyl ester of an unsaturated carboxylic acid selected from acrylic acid, methacrylic acid, fumaric acid and maleic acid.

4. The process as claimed in claim 1, wherein said compound having a lower critical surface energy is a silicone-containing compound selected from the group consisting of polymethylphenyl siloxane, polydimethyl siloxane, silicone varnish modified with an alkyd resin, silicone varnish modified with a phenolic resin, and silicone varnish modified with an epoxy resin.

5. The process as claimed in claim 1, wherein said compound having a lower critical surface energy is present in an amount of from about 0.01 to 50 wt. % based on the total amount of binder for the magnetic particles.

6. The process as claimed in claim 1, wherein said magnetic particles is present in an amount of from 30 to 95 wt. % of the total amount of carrier particle.

7. The process as claimed in claim 1, wherein said compound having a lower critical surface energy has a critical surface tension of not more than about 25 dyn/cm.

8. The process as claimed in claim 7, wherein said compound having a lower critical surface energy has a critical surface tension of not more than about 20 dyn/cm.

9. The process as claimed in claim 1, wherein said carrier composition is heated at a temperature below the glass transition point of said binder resin for a period of about 5 to 20 days.

10. The process as claimed in claim 1, wherein said carrier particle has an average particle size of from about 30 to 200 μm. carrier particles are heated while suspended in a heated air stream using a fluidized bed.

11. The process as claimed in claim 1, wherein said carrier particles are heated at a temperature not exceeding the glass transition point of the binder resin.

12. The process as claimed in claim 11, wherein said carrier particles are heated while suspended in a heated air stream using a fluidized bed.

13. A developer carrier produced by the process as claimed in claim 1.

14. A process for producing a developer carrier capable of inducing an electrostatic charge in a toner mixed therewith, which comprises the step of:

heating a mixture containing magnetic particles, a binder resin for dispersing the magnetic particles and a compound having a lower critical surface energy than the binder resin to obtain a molten mixture, cooling the molten mixture, grinding the cooled mixture to obtain carrier particles having an average particle size of about 10 to 400 μm and having the magnetic particles dispersed in the binder resin, and heating the carrier particles, said developer carrier having a higher concentration of the compound having a lower critical surface energy at the surface thereof.

15. The process as claimed in claim I4, wherein said carrier particles are heated at a temperature not exceeding the glass transition point of the binder resin.

16. The process as claimed in claim 15, wherein said carrier particles are heated while suspended in a heated air stream using a fluidized bed.

17. A developer carrier produced by the process as claimed in claim 14.

18. The process as claimed in claim 14, wherein said compound having a lower critical surface energy is a fluorine-containing compound selected from the group consisting of (A) homopolymers and copolymers comprising at least one monomer selected from tetrafluoroethylene, trifluoroethylene, vinylidence fluoride, monofluoroethylene, hexafluoropropylene, a fluorinated alkyl acrylate and a fluorinated alkyl methacrylate; (b) a fluorinated epoxy resin; (c) a fluorinated polyester resin; (d) a fluorinated silicone resin; (e) a fluorine-containing alkoxy-silane; (f) a fluorine-containing titanium acrylate; (g) fluorine-containing alkoxy titanium; (h) fluorine-containing alkoxy zirconium; and (i) a fluorine-containing surfactant.

19. The process as claimed in claim 18, wherein said compound having a lower critical surface energy is a fluorinated alkyl acrylate or methacrylate copolymerized with an alkyl ester of an unsaturated carboxylic acid selected from acrylic acid, methacrylic acid, fumaric acid and maleic acid.

20. The process as claimed in claim 14, wherein said compound having a lower critical surface energy is a silicone-containing compound selected from the group consisting of polymethylphenyl siloxane, polydimethyl siloxane, silicone varnish modified with an alkyl resin, silicone varnish modified with a phenolic resin, and silicone varnish modified with an epoxy resin.

21. The process as claimed in claim 14, wherein said compound having a lower critical surface energy is present in an amount of from about 0.01 to 50 wt. % based on the total amount of binder for the magnetic particles.

22. The process as claimed in claim 14, wherein said magnetic particles is present in an amount of from 30 to 95 wt. % of the total amount of carrier particle.

23. The process as claimed in claim 14, wherein said compound having a lower critical surface energy has a critical surface tension of not more than about 25 dyn/cm.

24. The process as claimed in claim 23, wherein said compound having a lower critical surface energy has a critical surface tension of not more than about 20 dyn/cm.

25. The process as claimed in claim 14, wherein said carrier composition is heated at a temperature below the glass transition point of said binder resin for a period of about 5 to 20 days.

26. The process as claimed in claim 14, wherein said carrier particle has an average particle size of from about 30 to 200 μm.

27. The developer carrier as claimed in claim 17, wherein said compound having a lower critical surface energy is a fluorine-containing compound selected from the group consisting of (a) homopolymers and copolymers comprising at least one monomer selected from tetrafluoroethylene, trifluoroethylene, vinylidene, fluoride, monofluoroethylene, hexafluoropropylene, a fluorinated alkyl acrylate and a fluorinated alkyl methacrylate; (b) a fluorinated epoxy resin; (c) a fluorinated polyester resin; (d) a fluorinated silicone resin; (e) a fluorine-containing alkoxysilane ; (f) a fluorine-containing titanium acylate; (g) fluorine-containing alkoxy titanium; (h) fluorine-containing alkoxy zirconium; and (i) a fluorine-containing surfactant.

28. The developer carrier as claimed in claim 27, which has an average particle size of at least about 50 μm.

29. The developer carrier as claimed in claim 28, wherein said fluorine-containing compound is selected from the group consisting of (a) homopolymers and copolymers comprising at least one monomer selected for tetrafluoroethylene, trifluoroethylene, vinylidene fluoride, monofluoroethylene, hexafluoropropylene, a fluorinated alkyl acrylate and a fluorinated alkyl methacrylate; (b) a fluorinated epoxy resin; (c) a fluorinated polyester resin; (d) a fluorinated silicone resin; (e) a fluorine-containing alkoxysilane; (f) a fluorine-containing titanium acylate; (g) fluorine-containing alkoxy titanium; (h) fluorine-containing alkoxy zirconium; and (i) a fluorine-containing surfactant.

30. The developer carrier as claimed in claim 29, wherein said fluorine-containing compound is present in an amount from about 0.01 to 50 wt. % based on the total amount of binder for the magnetic particles, and said magnetic particles are present in an amount of from about 30 to 95 wt. % of the total amount of said carrier.

31. The developer carrier as claimed in claim 29, wherein said fluorine-containing compound is present in an amount from about 0.1 to 20 wt. % based on the total amount of binder for the magnetic particles, and said magnetic particles are present in an amount of from about 45 to 90 wt. % of the total amount of said carrier.

32. The developer carrier as claimed in claim 18, wherein said carrier has an average particle size of from about 50 to 100 μm.

33. The developer carrier as claimed in claim 17, wherein said compound having a lower critical surface energy is a fluorine-containing compound selected from the group consisting of (a) homopolymers and copolymers comprising at least one monomer selected from tetrafluoroethylene, trifluoroethylene, vinylidene fluoride, monofluoroethylene, hexafluoropropylene, a fluorinated alkyl acrylate and a fluorinated alkyl methacrylate; (b) a fluorinated epoxy resin; (c) a fluorinated polyester resin; (d) a fluorinated silicone resin; (e) a fluorine-containing alkoxysilane; (f) a fluorine-containing titanium acrylate; (g) fluorine-containing alkoxy titanium; (h) fluorine-containing alkoxy zirconium; and (i) a fluorine-containing surfactant.

34. The developer carrier as claimed in claim 17, which has an average particle size of at least about 50 μmm.

35. The developer carrier as claimed in claim 34, wherein said fluorine-containing compound is selected from the group consisting of (a) homopolymers and copolymers comprising at least one monomer selected from tetrafluoroethylene, trifluoroethylene, vinylidene fluoride, monofluoroethylene, hexafluoropropylene, a fluorinated alkyl acrylate and a fluorinated alkyl methacrylate; (b) a fluorinated epoxy resin; (c) a fluorinated polyester resin; (d) a fluorinated silicone resin; (e) a fluorine-containing alkoxysilane; (f) a fluorine-containing titanium acrylate; (g) fluorine-containing alkoxy titanium; (h) fluorine-containing alkoxy zirconium; and (i) a fluorine-containing surfactant.

36. The developer carrier as claimed in claim 35, wherein said fluorine-containing compound is present in an amount from about 0.01 to 50 wt. % based on the total amount of binder for the magnetic particles, and said magnetic particles are present in an amount of from about 30 to 95 wt. % of the total amount of said carrier.

37. The developer carrier as claimed in claim 35, wherein said fluorine-containing compound is present in an amount from about 0.1 to 20 wt. % based on the total amount of binder for the magnetic particles, and said magnetic particles are present in an amount of from about 45to 90 wt. % of the total amount of said carrier.

38. The developer carrier as claimed in claim 34, wherein said carrier has an average particle size of from about 50 to 100 μm.

* * * * *